United States Patent [19]

Jacobs

[11] 3,980,072

[45] Sept. 14, 1976

[54] VENTILATING AND COOLING APPARATUS

[76] Inventor: Eugene A. Jacobs, 100 Shealey Ave., Towson, Md. 21204

[22] Filed: Jan. 24, 1975

[21] Appl. No.: 543,946

[52] U.S. Cl. ..... 126/299 B; 98/115 K; 126/34; 126/53

[51] Int. Cl.[2] ..... F24C 9/00

[58] Field of Search ..... 126/299 R, 299 A, 299 B, 126/299 C, 300, 53, 34; 98/115 K

[56] References Cited

UNITED STATES PATENTS

| | | | |
|---|---|---|---|
| 1,108,650 | 8/1914 | Wills | 126/53 X |
| 1,843,309 | 2/1932 | Woodard | 126/53 |
| 3,303,839 | 2/1967 | Tavan | 126/299 R |
| 3,386,365 | 6/1968 | Jensen | 126/299 R X |
| 3,854,388 | 12/1974 | King | 98/115 K |

*Primary Examiner*—Edward G. Favors
*Attorney, Agent, or Firm*—Cushman, Darby & Cushman

[57] ABSTRACT

Ventilating and cooling apparatus for cooking equipment heated by gas, oil, steam or electricity that reclaims radiant heat generated by cooking equipment by heat transfer panels through which cold water is circulated and preheated for use in hot water generating system or other system which can make use of preheated water. Heat transfer panels are positioned between the back edge of the canopy and the top of the cooking equipment and on the interior face of the canopy to collect radiant heat emitted directly and indirectly from the cooking equipment surfaces. An air passage behind the back panels serves to preheat incoming ventilation make-up air which is directed down, under and up along the front of the cooking equipment forming an air curtain and extracting heat from the body of the cooking equipment that is otherwise radiated to cooler bodies in close proximity to the heating surface. The flow of water through the panels is controlled by temperature regulating valves producing optimum temperature rise and flow. A pull down reflective shield positioned on the exterior of the leading edge of the canopy restricts the opening between the top of the cooking equipment and the leading edge of the canopy during prolonged cooking periods, reflecting radiant heat emitted directly and indirectly to the front but below the radiant heat panel on the interior face of the canopy back to the radiant heat panel at the back of the cooking equipment.

14 Claims, 3 Drawing Figures

42
45
47
46
41
44
43
40
32
39
36
34
16
50
37
35
31
38
32
33
17
11
12

VENTILATING AND COOLING APPARATUS

BRIEF DESCRIPTION OF THE PRIOR ART AND SUMMARY OF THE INVENTION

The invention relates to ventilating apparatus for cooking equipment including ranges, griddles, fry pans, kettles, steamers, fryers, broilers, ovens and the like heated (or fired) by gas, oil, steam or electricity and requiring ventilating apparatus to remove sensible heat, vapors and grease laden air in the vicinity of the cooking equipment.

There are various types of ventilating apparatus in use which remove sensible heat, vapors and grease laden air. These are generally updraft shelf-type hoods or canopy hoods with mesh filters or grease extractor apparatus built in various configurations from a low shelf-type close to the cooking surface to canopy types as high as seven feet above the floor. The shelf-type generally have fully enclosed backs and partially enclosed sides. Some canopy hoods also have enclosed backs and partially enclosed sides.

Grease extractor type hoods use permanent or removable baffles combined with relatively high velocity openings or slots to capture hot exhaust air and remove grease from it. These apparatus sometimes have washdown sprays built into them for removal of collected and accumulated grease. Some of these are normally operated dry except for the washdown period and others are operated wet with cold water sprays which provide a continuous air wash during operation. Some use removable cartridge without washdown or sprays of any kind. Some apparatus also is arranged with double duct construction to extract sensible heat from hot exhaust air to assist in heating supply make-up air.

These types of ventilating apparatus are usually found in commercial kitchens which prepare large quantities of food and in which the amibient room temperature is high, often above 120°F. While existing ventilators reduce heat somewhat by removing hot air, they cannot remove radiant heat, which is a major cause of cook discomfort.

The present invention relates to an apparatus which reclaims radiant heat generated by the cooking equipment in addition to ventilating the vicinity of the cooking equipment removing sensible heat, vapors and grease laden air. Accordingly, the radiant heat received by person or other bodies can be markedly reduced. Radiant heat is reclaimed by heat transfer panels mounted adjacent the cooking surface and through which cold water is circulated and heat by the radiant heat from the cooking surface.

The heated water circulating in the heat transfer panels is preferably piped to the hot water generating system providing hot water resulting in a savings of energy otherwise expended for those purposes. In addition to heat transfer panels and air supply at the back of the cooking equipment similar heat transfer panels and pull down reflective panels at the front of the cooking equipment on the interior and exterior faces respectively of the canopy preferably reclaim additional amounts of radiant heat directly and indirectly. In addition, air supplied down in back of the cooking equipment and under it preferably creates an air curtain at the front of the cooking equipment from the floor to the canopy which effectively encloses the cooking equipment and cools the body of the cooking equipment still further. The cooler body surfaces radiate less heat to surroundings beyond the air curtain.

The advantages of this invention are that radiant heat which is not reclaimed by ventilating apparatus now in use is reclaimed by this invention; the directed make-up air encloses the cooking equipment with a curtain of air containing and reducing sensible and radiant heat; the effective temperatures in the cook's working zones are substantially reduced; the temperature of incoming air is raised as it passes over the back, bottom and front surfaces of the cooking equipment; and the reclaimed radiant heat is available to heat water for dishwashing and other kitchen needs. Heat transfer panels at the front and pull down reflective panels further improve the reclaiming of radiant heat and effect lower working temperatures for periods of prolonged cooking.

DESCRIPTION

The preferred form of the invention is illustrated in the accompanying drawings, in which FIG. 1 is a partial cut-away, perspective view of the cooking equipment ventilating apparatus in accordance with the present invention.

Figure 1:
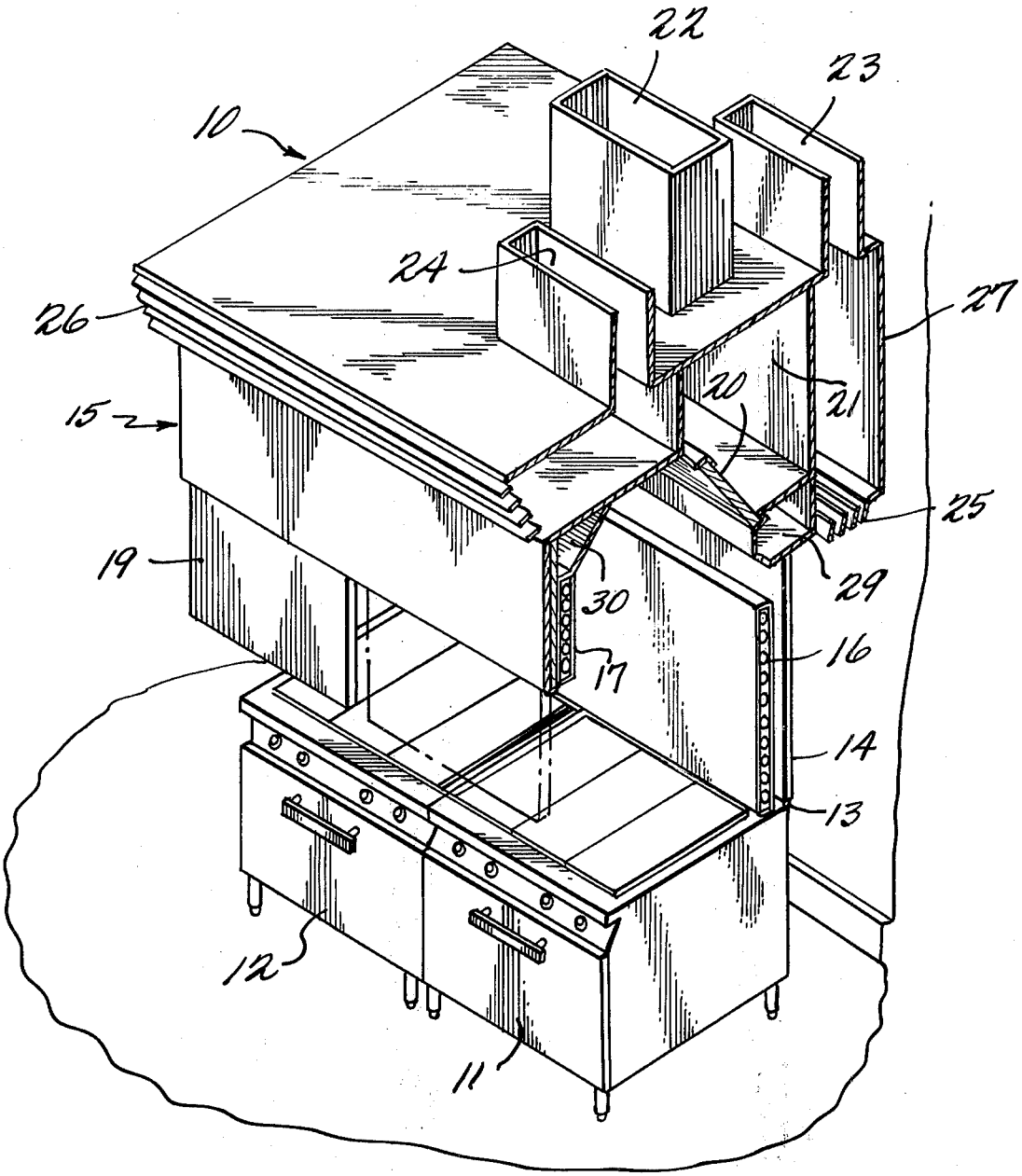

Referring to the drawings, cooking equipment ventilating apparatus 10 according to the present invention is mounted in operative position to and above conventional ranges 11 and 12 as indicated. Although the apparatus may be used in association with any cooking equipment, range 11 and range 12 are examples of such cooking equipment. Apparatus 10 is mounted above and to the back of cooking ranges 11 and 12 and, as indicated, immediately in front of flue connection 13 and mounted on extended flue riser 14, panel 16 can be mounted in any suitable manner on equipment which is not gas fired.

Apparatus 10 includes a canopy type hood 15 with one or more radiant heat reclaiming panels 16 extending below canopy 15 to the working level of ranges 11 and 12 and at the back thereof in front of the flue connection 13 and flue riser 14, in the case of cooking equipment with flues. One or more similar radiant heat panels 17 are mounted in the canopy 15 on the interior front and end faces or skirts 18. In addition, the canopy is equipped with conventional pull down type radiant heat reflecting type panels 19 at the front and ends. Exhaust air is drawn by a fan (not shown) across the face area between the cooking surface and the bottom edges of the canopy 15 and through conventional grease extractor 20 and the exhaust plenum chamber 21. The exhaust duct work and fan (not shown) are connected to the apparatus at 22 (FIG. 1) and the exhaust or ventilating air is conventionally discharged to the atmosphere.

Make-up air is conveyed to the apparatus by make-up air units connected by supply duct work to apparatus connections 23 and 24. The make-up air is distributed to air outlet grills 25 and 26 through supply air plenums 27 and 28 which are part of the apparatus. Radiant heat reclaiming panels 16 are piped in to piping space 29 and radiant heat reclaiming panels 17 are piped to pipe space 30. Radiant heat reclaiming panels 16 and 17 extend the length of the cooking equipment and the canopy which overhangs the ends of the cooking equipment and panels 17 are extended at the ends of the canopy as indicated.

Figure 3:
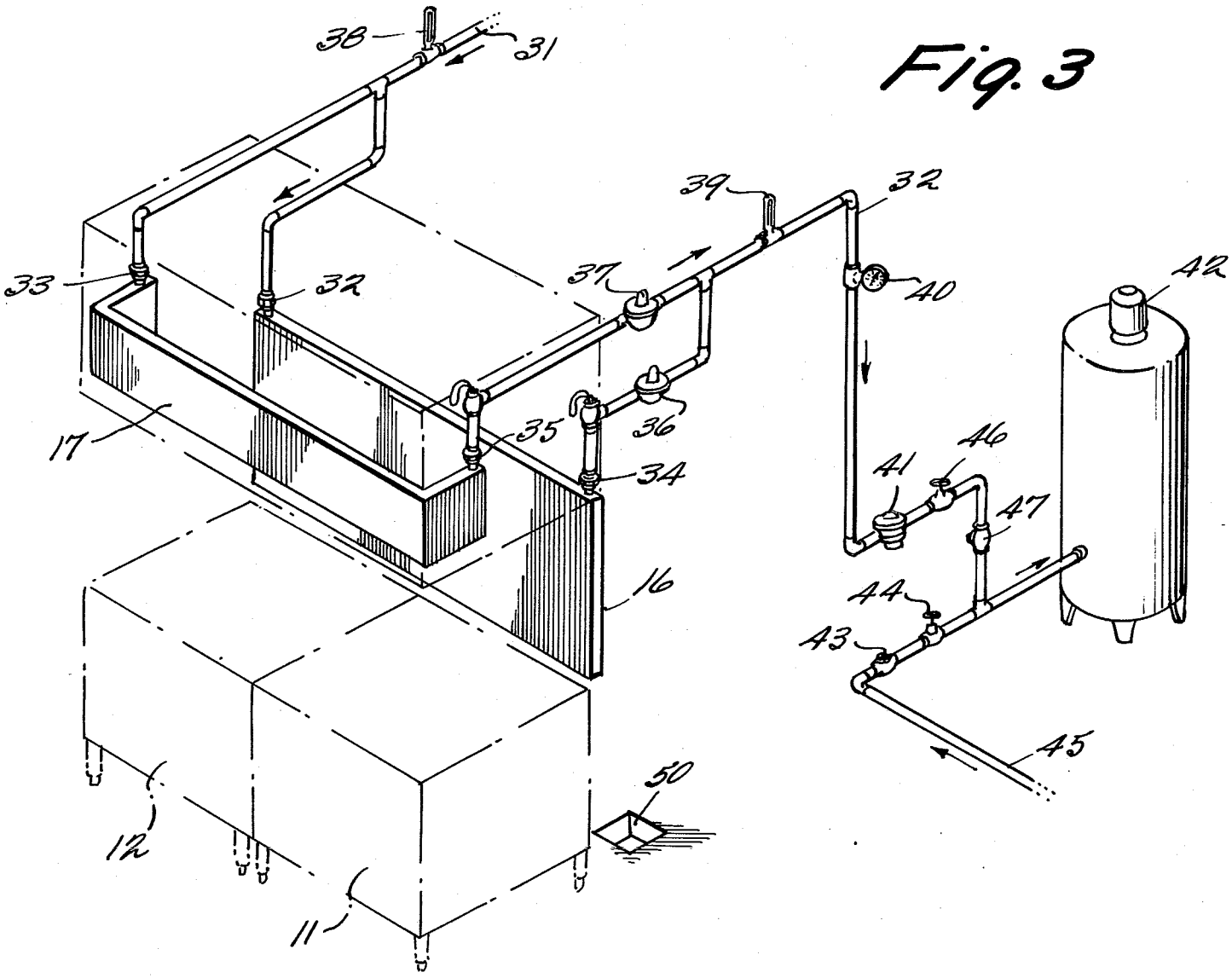
FIG. 3 is a schematic piping diagram for the radiant heat reclaiming panels.

Referring to FIG. 3, incoming cold water line 31 is connected to panel 16 with union connection 32 and to panel 17 with union connection 33. The heated water leaves panel 16 at union connection 34 and panel 17 and union connection 35. Conventional flow and balancing fittings 36 and 37 provide means of balancing flow and setting the flow in panels 16 and 17 respectively. Thermometer 38 indicates the temperature of incoming cold water and thermometer 39 indicates the temperature of exiting hot water. Pressure gauge 40 indicates operating pressure in hot water piping to circulator 41. Cold water supplied to hot water heater 42 through check valve 43 and gate valve 44 is mixed with the heated water from panels 16 and 17 which first passes through manual shut off valve 46 and check valve 47. The rate of flow through panels 16 and 17 is governed by the draw on hot water heater 42 and during no flow periods the rise in temperature at the panels 16 and 17 is allowed to rise above normal operating temperatures. Relief valves 48 and 49 piping to floor drain 50 (FIG. 3) provide pressure protection for panels 16 and 17. The product of average flow converted to pounds of water per hour times the average rise in temperature indicates the BTU of heat recovered by the radiant heat reclaiming cooking equipment ventilating apparatus to heat water used in the kitchen during the hours of operation.

Figure 2:
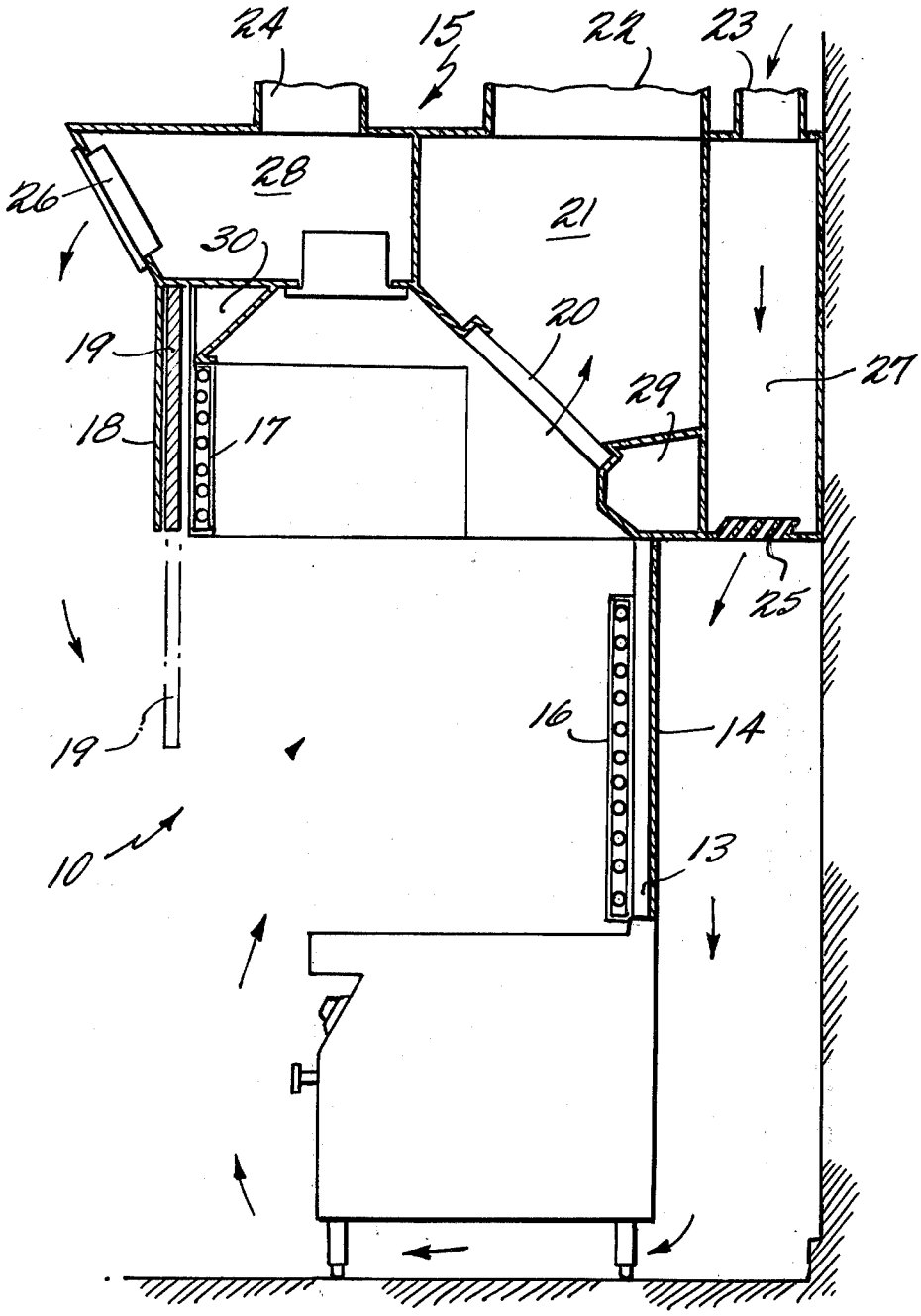
FIG. 2 is a vertical section through this cooking equipment ventilation apparatus.

As shown in FIG. 2, supply air is directed from air outlet grills 25 to and under the cooking equipment which is mounted on legs. Similar air outlet grills 26 at the front direct supply air out and down. The air from grill 25 is preheated as it passes panel 16. The number, size and position of air outlet grills 25 and 26 are selected to create an air curtain on all sides. These moving curtains of air meet at the front and ends between the cooking surfaces and the edges of the canopy and are drawn into chambers 21, 22 and 23 producing a ventilating effect. In addition the air curtains cool the body of the equipment and contain heat and vapors in the vicinity of the cooking equipment.

Many changes and modifications in the above described embodiment of the invention can of course be carried out without departing from the scope of the invention. Accordingly, that scope is intended to be limited only by the scope of the appended claims.

What is claimed is:

1. Apparatus for cooling and ventilating cooking equipment comprising:

means mounted above said equipment for exhausting air from the region between said equipment and said exhausting means, at least one heat exchanging panel extending along one side of said equipment to receive radiant heat therefrom and including means for circulating a cooling fluid within said panel between an inlet and outlet to carry away radiant heat impinging on said panel, and means for supplying said cooling fluid to said circulating means.

2. Apparatus as in claim 1 further including means for producing a curtain of air surrounding said equipment.

3. Apparatus as in claim 2 further including a second heat exchanging panel extending along the side of said equipment opposite said one side.

4. Apparatus as in claim 3 wherein said air curtain producing means includes a first chamber extending above said equipment and a first grill for directing air flow down along the rear of said equipment past the first panel, beneath said equipment, and up the front of said equipment into said region, a second chamber extending above said equipment, a second grill for directing air flow down said front and into said region, and means for supplying air at a pressure above atmospheric pressure to said first and second chambers.

5. Apparatus as in claim 4 wherein said exhausting means includes a third chamber, means for coupling said third chamber to an exhaust fan and a grease filter connected between said region and said third chamber.

6. Apparatus as in claim 1 further means for connecting the outlet of said panel to means for heating said fluid.

7. Apparatus as in claim 6 wherein said heating means is a hot water heater, and including said heater.

8. Apparatus as in claim 1 wherein said equipment includes at least a single range and including said range.

9. Apparatus for cooling and ventilating cooking equipment comprising:

means mounted above said equipment for exhausting air from the region between said equipment and said exhausting means, at least one heat exchanging means disposed with respect to said equipment to receive radiant heat therefrom and including means for circulating water therethrough and from an inlet to an outlet so the water is heated, means connecting the output of said circulating means to the input to a hot water heater for supplying water thereto, and means connected to the inlet of said circulating means for supplying water thereto.

10. Apparatus as in claim 9 further including means for producing a curtain of air surrounding said equipment.

11. Apparatus as in claim 9 wherein said heat exchanging means includes a panel extending along one side of said equipment and further including a second heat exchanging panel extending along the side of said equipment opposite said one side.

12. Apparatus as in claim 10 wherein said air curtain producing means includes a first chamber extending above said equipment and a first grill for directing air flow down along the rear of said equipment past the first panel, beneath said equipment, and up the front of said equipment into said region, a second chamber extending above said equipment, a second grill for directing air flow down said front and into said region, and means for supplying air at a pressure above atmospheric pressure to said first and second chambers.

13. Apparatus as in claim 11 wherein said exhausting means includes a third chamber, means for coupling said third chamber to an exhaust fan and a grease filter connected between said region and said third chamber.

14. Apparatus as in claim 8 wherein said equipment includes at least a single range and including said range.

* * * * *